US008517435B2

(12) United States Patent
Runge

(10) Patent No.: US 8,517,435 B2
(45) Date of Patent: Aug. 27, 2013

(54) QUICKLY MOUNTABLE ESPAGNOLETTE LOCK

(75) Inventor: Friedhelm Runge, Wuppertal (DE)

(73) Assignee: EMKA Beschlagteile GmbH & Co. KG (DE)

( * ) Notice: Subject to any disclaimer, the term of this patent is extended or adjusted under 35 U.S.C. 154(b) by 458 days.

(21) Appl. No.: 12/738,054

(22) PCT Filed: Oct. 14, 2008

(86) PCT No.: PCT/EP2008/008675

§ 371 (c)(1),
(2), (4) Date: Apr. 14, 2010

(87) PCT Pub. No.: WO2009/052975

PCT Pub. Date: Apr. 30, 2009

(65) Prior Publication Data

US 2011/0266815 A1 Nov. 3, 2011

(30) Foreign Application Priority Data

Oct. 19, 2007 (DE) ..... 20 2007 014 642 U

(51) Int. Cl.

| | |
|---|---|
| ***E05C 3/06*** | (2006.01) |
| ***E05C 3/02*** | (2006.01) |
| ***E05C 5/00*** | (2006.01) |
| ***E05B 3/00*** | (2006.01) |

(52) U.S. Cl.

USPC ..... 292/200; 292/194; 292/195; 292/197; 292/198; 292/348; 292/57; 292/58; 292/71; 292/67; 292/63; 292/64; 292/65; 292/66

(58) Field of Classification Search

USPC ..... 292/194, 195, 197, 198, 200, 202, 292/57, 58, 71, 63, 64, 65, 66, 348, DIG. 11, 292/DIG. 31, DIG. 53, DIG. 54, DIG. 64

See application file for complete search history.

(56) References Cited

U.S. PATENT DOCUMENTS

| | | | | |
|---|---|---|---|---|
| 4,910,982 | A * | 3/1990 | Dana | 70/370 |
| 5,413,392 | A * | 5/1995 | Schlack et al. | 292/204 |

FOREIGN PATENT DOCUMENTS

| | | |
|---|---|---|
| DE | 4006707 | 11/2006 |
| EP | 0175211 | 3/1986 |
| EP | 1722050 | 11/2006 |
| WO | WO99/14458 | 3/1999 |

* cited by examiner

*Primary Examiner* — Thomas Beach
*Assistant Examiner* — Edwin Toledo-Duran
(74) *Attorney, Agent, or Firm* — Robert Becker; Becker & Stachniak, P.C.

(57) ABSTRACT

An espagnolette lock for a door or shutter. An actuating shaft can be rotatably mounted within the interior of a housing and can be coupled with a lock-actuator. The actuating shaft is monolithically formed with a tongue. A securement mechanism is configured for insertion into the housing parallel to the plane of a door panel or of the shutter for fixing the housing in position on the door panel or shutter. The securement mechanism is further configured for being supported against the door panel or shutter. When a mounting of the espagnolette lock is completed, the securement mechanism is configured to engage the actuating shaft to thereby secure and fix the actuating shaft in position in the housing.

17 Claims, 3 Drawing Sheets

QUICKLY MOUNTABLE ESPAGNOLETTE LOCK

BACKGROUND OF THE INVENTION

The instant application should be granted the priority dates of Oct. 19, 2007, the filing date of the corresponding German patent application 20 2007 014 642.6, as well as Oct. 14, 2008, the filing date of the International patent application PCT/EP2008/008675.

The present invention relates to an espagnolette, or casement or rotary, lock for a door or shutter, with a housing that can be fixed in position on the door panel or the shutter, and with an actuating shaft that is rotatably disposed in the housing, on the one hand being non-rotatably connected with a tongue, and on the other hand can be coupled with a look-actuating means.

An espagnolette lock having the aforementioned features is known from EP 0 175 211 A1. This espagnolette lock is comprised of the housing, which is to be placed into an appropriate opening in the door or shutter, and which on the outside is provided with an external thread for the threading-on of a fastening nut on the rear side until it rests against the door panel or the shutter, so that by means of the fastening nut the housing is secured on the door panel or the shutter.

Rotatable mounted in the interior of the housing is an actuating shaft, on the end of which, in a form-locking connection therewith, a tongue can be placed and by means of a screw that can be threaded, into the actuating shaft can be secured to the actuating shaft. Thus, the disadvantage of this espagnolette lock is that it is comprised of at least five individual components, each of which has to be manufactured individually, and the mounting or assembly of which to form a functional espagnolette lock requires a plurality of steps, and is therefore complicated and cumbersome.

SUMMARY OF THE INVENTION

It is therefore an object of the present invention, with an espagnolette lock having the aforementioned general features, to reduce the number of individual components and to reduce the mounting effort for the espagnolette lock.

The basic concept of the present invention is that the tongue is monolithically formed with the actuating shaft and the actuating shaft is mounting in the interior of the housing, and that the housing is fixed in position on the door panel or the shutter by means of a securement element that can be inserted into the housing parallel to the plane of the door panel or the shutter, and that is to be supported against the door panel or the shutter, wherein when mounting of the espagnolette lock is completed, the securement element engages the actuating shaft to thereby secure and fix the actuating shaft in the housing. The present invention has the advantage of reducing the number of components, because the espagnolette lock is now comprised of only three components, namely the housing, the actuating shaft with the tongue, and the securement element. This not only facilitates the manufacture of the individual components, but also facilitates their mounting or assembly. In a first mounting step, the actuating shaft must be inserted into the housing, whereby in a second mounting step the housing is fixed in position on the door panel or the shutter by means of the securement element, whereby at the same time by means of this securement there also results a reliable fixing of the actuating shaft in position in the housing.

Pursuant to one concrete embodiment of the invention, the actuating shaft can mounted in the housing via a mounting collar, and the securement element in its position where it is inserted into the housing, can engage into the mounting collar of the actuating shaft.

To be able to compensate for possible varying panel thicknesses and/or tolerances of the espagnolette lock, pursuant to one embodiment of the invention the securement element, in its position where it is inserted into the housing, secures the housing in place against the door panel or the shutter due to an established bias. In this connection, the securement element can in particular be supported against the door panel or the shutter via a resiliently configured projection or shoulder, thereby biasing the housing against the door panel or the shutter.

Pursuant to a first embodiment, the securement mechanism has a forked-shaped configuration with two parallel projections that are spaced from one another, whereby the projections are respectively guided through openings of the housing that are disposed across from one another and are accommodated in a respective opening or recess disposed in the mounting collar of the actuating shaft. Expediently in this connection, the opening or recess is embodied as an annular groove, so that the actuating shaft can rotate relative to the projections of the securement element that extend through it.

If the securement means is at the same time to take care of the biasing of the housing with the door panel or the shutter, pursuant to one embodiment of the invention the projection or shoulder is formed by two supporting projections that extend parallel to the projections and extend about the outside of the housing; in this connection, for the establishment of a desired spring effect, the supporting projections have a double-walled configuration with a respective strip that rests resiliently against the door panel or the shutter.

Alternatively, the supporting projections can have a concave configuration, i.e. are embodied with an arching or curvature that protrudes in the direction of the door panel or the shutter, thereby establishing the biasing in the position in which the projections are inserted into the housing; with such a bulging of the respective supporting projections, the required biasing can also be established in a straightforward form.

With regard to a reliable fixing of the espagnolette lock in place on the door panel or the shutter, pursuant to one embodiment of the invention the supporting projections are positively fixed in position in a respective channel or slot formed on the outer side of the housing, whereby alternatively or in addition thereto, the housing can be provided with recesses on its outer side that serve for positively receiving the securement element. In this regard, the securement element is advantageously positively, and thereby immovably, connected with the housing of the espagnolette lock and thereby at the same time ensures a reliable securement of the housing to the door panel or the shutter.

With respect to limiting the rotation of the tongue, relative to the housing, pursuant to this embodiment the tongue or actuating shaft can be provided with a radially extending projection that engages in a slot that fixes the angle of rotation of the actuating shaft with its tongue relative to the housing.

Pursuant to an alternative embodiment, the securement means is embodied as at least one pin that transversely extends through the housing in two openings that are respectively disposed across from one another, whereby the mounting collar of the actuating shaft is provided with two slots having the shape of quarter circles for receiving the pin in a manner that enables a rotation of the actuating shaft about 90°. With this embodiment, the limitation of the rotation of the actuating shaft with its tongue relative to the housing is advantageously shifted into the interior of the housing in that the slots respectively ensure for the abutment during the rotation of the actuating shaft relative to the pin that is fixed in position in the housing.

Pursuant to one embodiment of the invention, instead of a single pin two pins, which can be inserted into the housing from respectively oppositely disposed sides, can also be provided.

With the embodiment having a securement element embodied as a pin, pursuant to one embodiment of the invention each pin can be provided at its outer end with a shoulder that by means of an undercut is provided with a resilient configuration; in this way, the or each pin ensures a fixed securement of the housing in position relative to the door panel or the shutter.

Pursuant to an alternative embodiment, for the establishment of the required biasing, each pin can be provided with an arching or curvature that projects in the direction of the door panel or the shutter, i.e. each pin has a concave configuration, as a result of which, with the pin inserted into the housing, the biasing is established.

Pursuant to one embodiment of the invention, disposed on actuating shaft and securement element can be respective detents or notches that indicate the two 90° positions of the actuating shaft, with the espagnolette lock opened and with the lock closed; these measures are intended to facilitate mounting of the actuating shaft in the housing by making it possible to sense or feel the two rotational positions of the actuating shaft in the housing.

To facilitate the mounting, pursuant to one embodiment of the invention the actuating shaft is axially releaseably arrested in the housing by means of a notch/detent configuration. This makes it possible, during the course of a preassembly, to arrest the actuating shaft, including the tongue, in the housing, so that upon final assembly or mounting of the espagnolette lock on the door panel or the shutter it is necessary only to guide the espagnolette lock and tongue through the opening provided in the door panel or the shutter, whereafter merely the securement means is to be inserted into the housing. Due to the prearresting of the actuating shaft in the housing, there is seen to it that the openings in the housing for the securement means are aligned, with the openings or recesses provided in the mounting collar of the actuating shaft for receiving the securement means.

The actuating shaft, in the region of its mounting collar that faces the lock-actuating means that is to be provided, can be provided with a seal groove having placed therein a seal that provides sealing relative to the housing; in this way, a sealing of the container that is closed off by the door panel or the shutter against the outside atmosphere is effected in the region of the espagnolette lock.

BRIEF DESCRIPTION OF THE DRAWINGS

The drawing shows exemplary embodiments of the invention, which will be described subsequently, and in which.

DESCRIPTION OF SPECIFIC EMBODIMENTS

Figure 1:
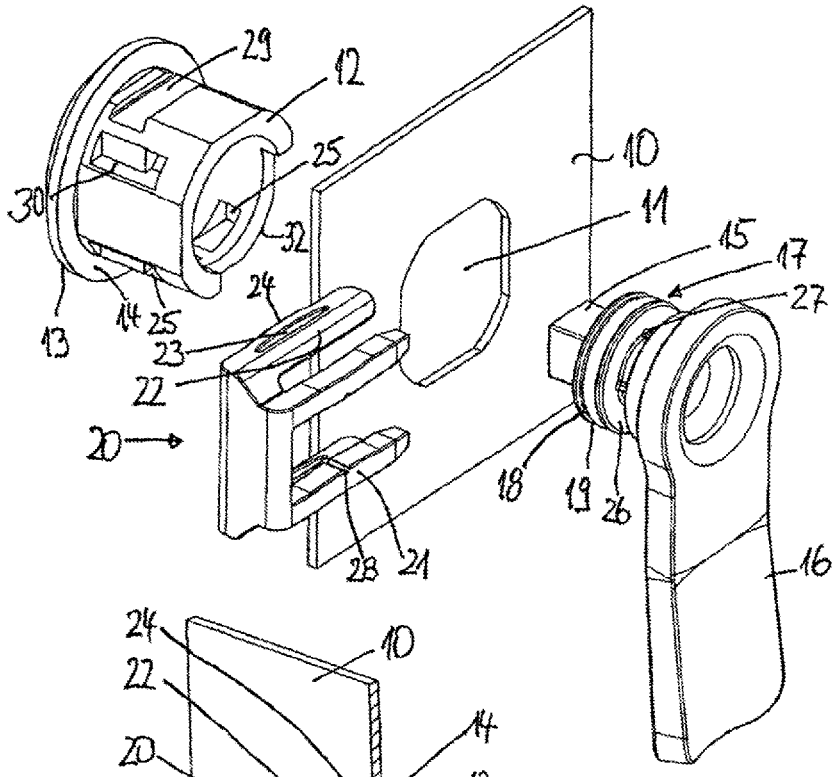
FIG. 1 is a rearward, exploded perspective view of the individual components of an espagnolette lock.
Figure 2:
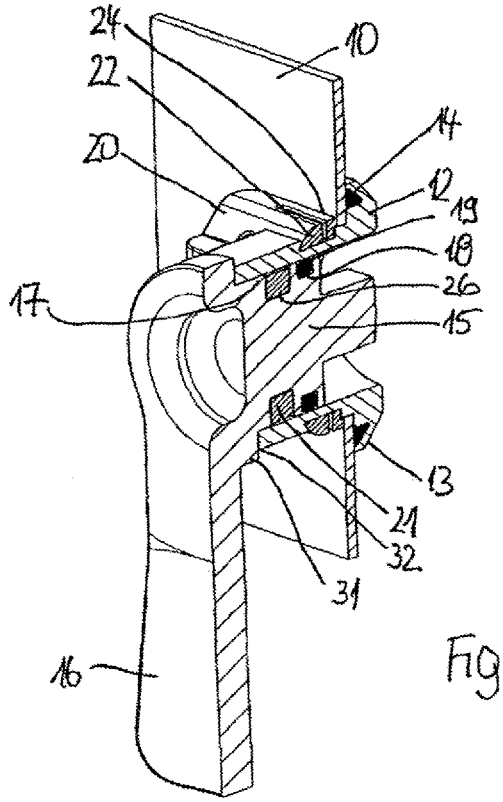
FIG. 2 is a perspective longitudinal sectional view of the subject matter of FIG. 1 with the espagnolette lock assembled and mounted.

The espagnolette, or casement or rotary, lock, the individual components of which are illustrated in FIG. 1, and which is to be assembled or mounted on a door leaf or panel 10 that is provided with an opening or aperture 11, is comprised of a housing 12, which can be inserted into the door opening 11 until a housing flange 13, which on the outer side projects radially, comes to rest against the door panel 10. To seal the housing 12 against the door panel 10, a seal 14 is disposed on the underside of the housing flange 12 (FIG. 2). The opening 11 has an angular shape, with the housing 12 having a conforming outer contour, so that the housing 12 is fixed in position in the opening 11 such that it cannot rotate.

As a second component, the espagnolette lock has an actuating shaft 15 that can be inserted into the housing 12 and on which is monolithically formed a tongue 16. To mount the actuating shaft 15 in the housing 12, the actuating shaft 15 has a mounting collar 17, which in that region thereof disposed toward the front side of the housing is provided with a seal groove 18 having a seal 19 placed therein (FIG. 2), thus effecting a sealing of the actuating shaft 15 relative to the housing 12.

A fastening or securement element 20 is provided to on the one hand mount the housing 12 on the door panel 10, and on the other hand to secure the actuating shaft 15 in place in the housing 12; the securement element has an essentially fork-shaped configuration, with two tenons or projections 21 that extend parallel to the plane of the door panel 10. The projections 21 can be inserted into openings 25, which are respectively disposed across from one another in the housing 12, in such a way that the projections 21 of the securement element 20 extend through the housing. In as much as in so doing the projections 21 pass the actuating shaft 15 that is mounted in the housing 12, the mounting collar 17 of the actuating shaft 15 is provided with an annular groove 26 that accommodates the projections 21 of the securement element 20. In this way, the actuating shaft 15 is rotatable in the housing 12 relative to the stationary projections 21, yet at the same time is fixed in the axial direction. To be able to sense the respective positions of the actuating shaft 15 in the housing 12, detents 27, which correspond to the two positions of the tongue 16 (closing position-opening position), are formed in the annular groove 26 of the mounting collar 17, with notches 28 provided on the projections 21 being associated with the detents.

To secure the housing 12 in place against the door panel 10, the securement element 20 is furthermore provided with supporting projections 22 that are spaced radially and axially from the projections 21 and that extend about the outside of the housing 12, in which connection they are positively held in channels or slots 29 formed on the outer side of the housing. Furthermore, on its outer side, the housing 12 is provided with recesses 30 for positively accommodating the securement element 20, so that the securement element 20 is immovably fixed on the housing 12. To secure the securement element 20 in place against the door panel 10, the supporting projections 22 have a double-walled configuration, with strips 24 that project toward the door panel 10 being provided that are offset from the supporting projections 22 by a cutout 23 in such a way that the strips 24 can spring or deflect into the cutout 23 to thereby exert a resilient bias in the direction of the door panel 10. In this way, a compensation of different thicknesses of the door panel 10, as well as tolerances in the manufacture of the housing, are taken into account.

With the illustrated embodiment, a limiting of the rotational movement of the tongue 16 relative to the housing 12 is effected externally on the housing 12 in that that end of the housing 12 that faces the tongue is provided with a slot 32 that extends over 90° and which is engaged by a radially extending projection 31 disposed in the region of the transition of the actuating shaft 15 to the tongue 16, so that the slot 32 forms the rotation-delimitation for the movement of the projection 31 therein.

Figure 3:
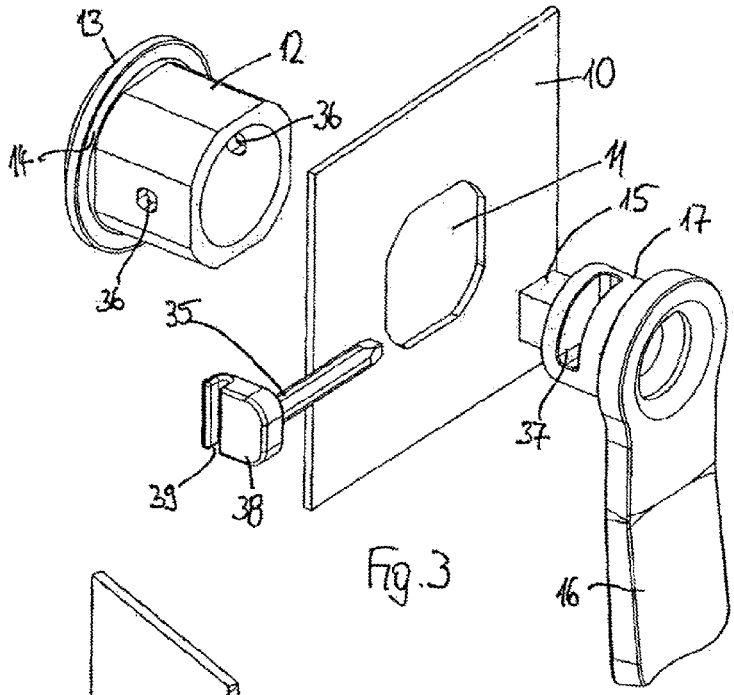
FIG. 3 is a different exemplary embodiment of the subject matter of FIG. 1.
Figure 4:
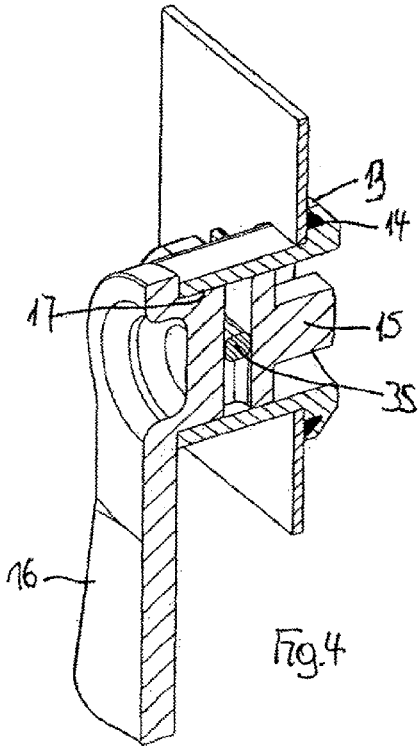
FIG. 4 is a perspective longitudinal sectional view of the espagnolette lock of FIG. 3 in the assembled and mounted state.
Figure 5:
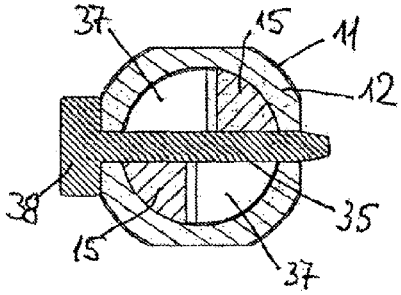
FIG. 5 is a sectioned detailed view of the actuating shaft of FIG. 3 or FIG. 4 with securement pin.

With the embodiment illustrated in FIGS. 3 to 5, in place of the securement element 20 described in conjunction with FIGS. 1 and 2, a fastening or securement pin 35 is provided that can be inserted transversely through openings 36 formed opposite one another in the walls of the housing 12, and thereby extend through the housing 12. In as much as in this connection the pin 35 must pass the actuating shaft 15 that is mounted in the housing 12, the mounting collar 17 of the actuating shaft 15 is provided with diagonally oppositely disposed slots 37 having the shape of a quarter of a circle (FIG. 5), so that by means of this configuration at the same time a delimitation of the rotational movement of the actuating shaft 15 relative to the housing 12 to 90° is effected. To this extent, the rotational delimitation for the rotation of the tongue 16 is relocated into the interior of the housing 12. On the outside, a shoulder 38 disposed at an end of the pin 35 is supported against the door panel 10, whereby the shoulder 38 is provided with an undercut 39, so that the shoulder 38 can be resilient in order to establish a spring effect for compensating for varying panel thicknesses and/or tolerances.

Figure 6:
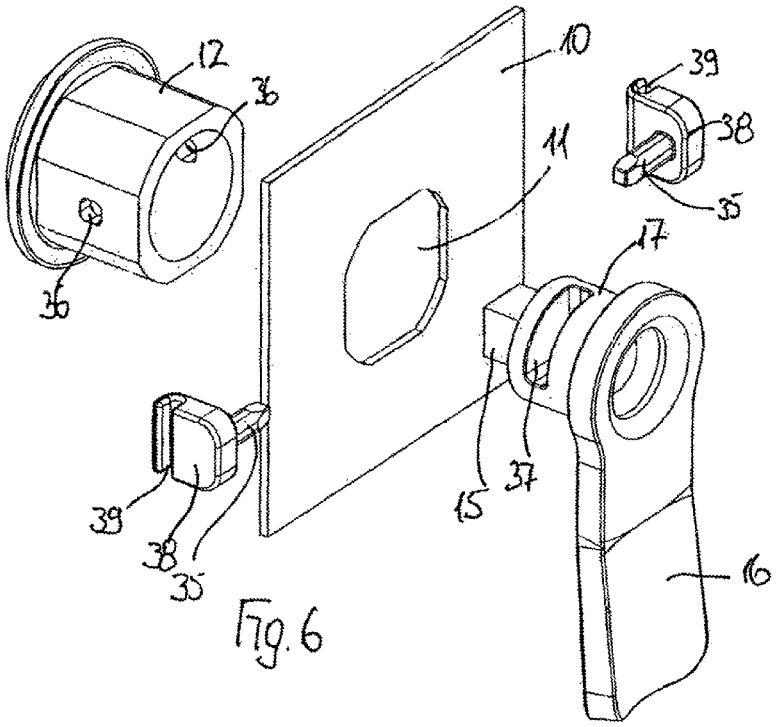
FIG. 6 is a modified embodiment of the subject matter of FIG. 3 with two securement pins.
Figure 7:
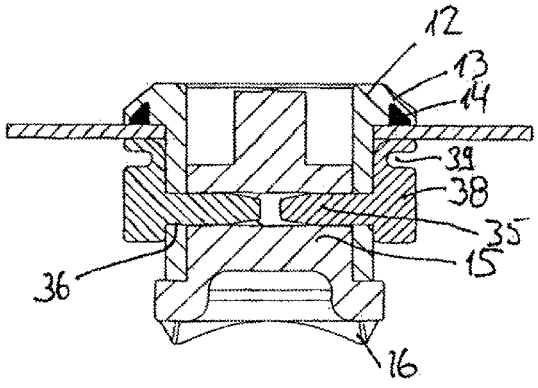
FIG. 7 is a sectioned plan view of the subject matter of FIG. 6.

Finally, with the embodiment illustrated in FIGS. 6 and 7, instead of one pin 35 two partial pins 35 can respectively be inserted from both sides of the housing 12, whereby the function of the two pins 35 corresponds with the function of the single pin 35 as described in conjunction with FIGS. 3 to 5. With this embodiment, in contrast to the securement of the housing 12 on the door panel 10 on only one side, there advantageously results a symmetrical support and securement of the housing 12 in place against the door panel 10 on both sides.

The features of the subject matter of these documents disclosed in the preceding description, the patent claims, the abstract and the drawing can be important individually as well as in any desired combination with one another for realizing the various embodiments of the invention.

The specification incorporates by reference the disclosure of German application 20 2007 014 642.6 filed Oct. 19, 2007, as well as International application PCT/EP2008/008675 filed Oct. 14, 2008.

The present invention is, of course, in no way restricted to the specific disclosure of the specification and drawings, but also encompasses any modifications within the scope of the appended claims.

The invention claimed is:

1. An espagnolette lock for a door having a panel or for a shutter, comprising:

a housing, an actuating shaft for rotatable mounting within the interior of said housing, wherein said actuating shaft is monolithically formed with a tongue; and a securement mechanism configured for insertion into said housing parallel to a plane of the door panel or of the shutter for fixing said housing in position on the door panel or the shutter, wherein said securement mechanism is further configured for being supported against the door panel or the shutter, and wherein, when a mounting of said espagnolette lock is completed, said securement mechanism is configured to engage said actuating shaft to thereby secure and fix said actuating shaft in position in said housing, wherein said actuating shaft is provided with a mounting collar, further wherein said actuating shaft is mounted in said housing via said mounting collar, and wherein said securement mechanism, in a position when it is inserted into said housing, engages into said mounting collar of said actuating shaft, and wherein said securement mechanism has a fork-shaped configuration and comprises two parallel first projections that are spaced from one another and extend transversely through said housing into two openings that are respectively disposed in said housing opposite one another, and wherein said first projections are received in a respective opening or recess disposed in said mounting collar of said actuating shaft.

2. An espagnolette lock according to claim 1, wherein said securement mechanism, in said position where it is inserted into said housing, secures said housing in place against the door panel or the shutter due to an established bias.

3. An espagnolette lock according to claim 1, wherein said securement mechanism is supported against the door panel or the shutter via a resiliently configured projection or shoulder, and wherein said securement mechanism is supported against the door panel or the shutter via said projection or shoulder to thereby bias said housing against the door panel or the shutter.

4. An espagnolette lock according to claim 1, wherein said opening or recess of said mounting collar is embodied as an annular groove.

5. An espagnolette lock according to claim 1, wherein said projection or shoulder is formed by two supporting projections that extend parallel to the first projections and extend about an outside of said housing.

6. An espagnolette lock according to claim 5, wherein said supporting projections have a double-walled configuration, each being formed with a respective strip that rests resiliently against the door panel or the shutter.

7. An espagnolette lock according to claim 5, wherein said supporting projections are embodied with an arching or curvature that protrudes in the direction of the door panel or the shutter to thereby establish the bias in the position in which said securement mechanism is inserted into said housing.

8. An espagnolette lock according to claim 5, wherein channels or slots are formed on an outer side of said housing, and wherein said supporting projections are positively fixed in position in said channels or slots.

9. An espagnolette lock according to claim 2, wherein an outer side of said housing is provided with recesses that serve for a positive receiving of said securement mechanism.

10. An espagnolette lock according to claim 1, wherein said housing is provided with a slot, and wherein said tongue or said actuating shaft is provided with a radially extending projection that engages into said slot, which fixes an angle of rotation of said actuating shaft, with its tongue, relative to said housing.

11. An espagnolette lock according to claim 1, wherein respective detents or notches are disposed on said actuating shaft and said securement mechanism for indicating two 90 positions of said actuating shaft, with said espagnolette lock opened and closed.

12. An espagnolette lock according to claim 1, wherein said actuating shaft is axially releasably arrested in said housing by means of a notch/detent configuration.

13. An espagnolette lock according to 1, wherein said actuating shaft, in that region of its mounting collar that faces the lock-actuating means that is to be provided, has a seal groove with a seal placed therein for providing sealing relative to said housing.

14. An espagnolette lock for a door having a panel or for a shutter, comprising:

a housing;

an actuating shaft for rotatable mounting within the interior of said housing, wherein said actuating shaft is monolithically formed with a tongue, and a securement mechanism configured for insertion into said housing parallel to a plane of the door panel or of the shutter for fixing said housing in position on the door panel or the shutter wherein said securement mechanism is further configured for being supported against the door panel or the shutter, and wherein, when a mounting of said espagnolette lock is completed, said securement mechanism is configured to engage said actuating shaft to thereby secure and fix said actuating shaft in position in said housing, wherein said actuating shaft is provided with a mounting collar, further wherein said actuating shaft is mounted in said housing via said mounting collar, and wherein said securement mechanism, in a position when it is inserted into said housing, engages into said mounting collar of said actuating shaft, and wherein said securement mechanism comprises at least one pin that extends transversely through said housing in two openings that are respectively disposed in said housing opposite one another, and wherein said mounting collar of said actuating shaft is provided with two slots, which have the shape of a quarter of a circle, for receiving said at least one pin in a manner that enables a rotation of said actuating shaft about 90°.

15. An espagnolette lock according to claim 14, wherein said securement mechanism has two pins that are insertable into said openings of said housing from respectively oppositely disposed sides.

16. An espagnolette lock according to claim 14, wherein each of said pins, on an outer end thereof, is provided with a shoulder that has an undercut to provide said shoulder with a resilient configuration.

17. An espagnolette lock according to claim 14, wherein each of said pins is provided with an arching or curvature that protrudes in the direction of the door panel or the shutter to thereby establish a biasing when said pin is inserted into said housing.

* * * * *